US008725429B2

(12) United States Patent
McNeill et al.

(10) Patent No.: US 8,725,429 B2
(45) Date of Patent: May 13, 2014

(54) FATIGUE MONITORING

(75) Inventors: Scot McNeill, Houston, TX (US); Puneet Agarwal, Houston, TX (US)

(73) Assignee: Stress Engineering Services, Inc., Houston, TX (US)

( * ) Notice: Subject to any disclaimer, the term of this patent is extended or adjusted under 35 U.S.C. 154(b) by 378 days.

(21) Appl. No.: 13/221,665

(22) Filed: Aug. 30, 2011

(65) Prior Publication Data

US 2012/0303293 A1 Nov. 29, 2012

Related U.S. Application Data

(60) Provisional application No. 61/491,083, filed on May 27, 2011.

(51) Int. Cl.
*G06F 19/00* (2011.01)
*E21B 47/00* (2012.01)

(52) U.S. Cl.
CPC ..... *E21B 47/0001* (2013.01)
USPC ..... 702/34

(58) Field of Classification Search
CPC ..... E21B 47/0001
USPC ..... 702/34
See application file for complete search history.

(56) References Cited

U.S. PATENT DOCUMENTS

| | | | | |
|---|---|---|---|---|
| 6,802,221 | B2 * | 10/2004 | Hedeen et al. | 73/587 |
| 7,080,689 | B2 | 7/2006 | Guesnon et al. | |
| 7,328,741 | B2 | 2/2008 | Allen et al. | |
| 2003/0230409 | A1 | 12/2003 | Guesnon et al. | |

FOREIGN PATENT DOCUMENTS

| | | |
|---|---|---|
| FR | 0207245 | 6/2002 |

OTHER PUBLICATIONS

Shi, C., Manuel, L. and Tognarelli, M. A., 2010, Alternative Empirical Procedures for Fatigue Damage Rate Estimation of Instrumented Risers Undergoing Vortex-Induced Vibration, Proceedings of the 29th OMAE conference, Shanghai, China, OMAE2010-20992, 12 pages.

Kaasen, K. E. and Lie, H., 2003, Analysis of Vortex Induced Vibration of Marine Risers, Modeling Identification and Control vol. 24(2), pp. 71-85.

Mukundan, H., 2008, Vortex-induced Vibration of Marine Risers: Motion and Force Reconstruction from Field and Experimental Data, Ph.D. Dissertation, Massachusetts Institute of Technology, Cambridge, MA, 205 pages.

Benasciutti, D., 2004, Fatigue Analysis of Random Loadings, Ph.D. Dissertation, Department of Civil and Industrial Engineering, University of Ferrara, Italy, 269 pages.

Bendat, J.S. and Piersol, A.G. Random Data Analysis and Measurement Procedures. Wiley & Sons. New York, 2000, pp. 437-441.

(Continued)

*Primary Examiner* — Bryan Bui
(74) *Attorney, Agent, or Firm* — Gordon T. Arnold; Arnold, Knobloch & Saunders, L.L.P.

(57) ABSTRACT

A method and system are provided to reconstruct vibration responses such as stress and fatigue damage at desired locations in a structure from a limited number of vibration measurements at a few locations in the structure. Vibration response measurements can be of any type, e.g. acceleration, angular velocity, strain, etc. The desired locations can be anywhere within the domain of the structure and may include the entire structural domain. Measured vibration responses may be of uniform type or combinations of different types.

35 Claims, 10 Drawing Sheets

(56) References Cited

OTHER PUBLICATIONS

Principia, DeepLines—Global analysis of risers, moorings and flowlines, 2010, located at: http://www.principia.fr/expertise-fields-software-products-deeplines-126.html, 3 pages.

Principia, DeepLines Risers, pipelines and moorings design software, Software Datasheet, [retrieved on Jul. 18, 2011], retrieved from the Internet: http://www.principia.fr/upload/image/pdf/DEEPLINES-in-Brief.pdf, 2 pages.

PennEnergy, France: Computational flow dynamics aids FPSO stability studies, vol. 62, Issue 8, located at: http://www.pennenergy.com/index/petroleum/display/152129/articles/offshore/volume-62/issue-8/news/france-computational-flow-dynamics-aids-fpso-stability-studies.html, Aug. 8, 2002, 3 pages.

Principia, DeepVIV Vortex Induced Vibrations analysis software, Software Datasheet. [retrieved on Jul. 18, 2011], retrieved from the Internet: http://www.principia.fr/upload/image/pdf/deepviv-in-brief.pdf, 2 pages.

* cited by examiner

FATIGUE MONITORING

CROSS-RELATED APPLICATIONS

This application claims the benefit of U.S. provisional application No. 61/491,083 filed May 27, 2011.

BACKGROUND

Vibration-induced fatigue damage and strain induced from other sources is a problem in various structures, including marine risers, which are used in offshore drilling, production, insertion and export. Marine risers span the distance between surface platforms and the seabed and are typically found in two general types: top tensioned risers and catenary risers. See, e.g., U.S. Pat. No. 7,328,741 (incorporated herein by reference for all purposes). However, measurement or estimation of riser fatigue has been difficult or impossible, due to the nature of the risers and the environment in which they are used.

As mentioned in the '741 patent, previous methods involved monitoring of ball/flex joint angle values or other systems that provided a limited set of measurements, mainly of the lower flex joint that do not allow for "real-time" management of the entire riser system. The method outlined in the '741 patent utilizes data from an upper and lower module connected to the upper and lower portions of the riser, respectively, providing dynamic motion and orientation data of the two ends of the riser. There are only general statements on how the data from the two extreme ends of the riser can used to estimate stress at desired locations along the riser: the dynamic motions and orientations from the upper and lower ends of the riser are compared to a "table of models" or "database of vibration signatures" to select the best matching model or signature; then, stresses are determined at a "plurality of riser sections."

Attempting to determine the dynamic motions and stresses along a riser using only data from two endpoints is highly prone to error. Also, a very large number of predetermined models have to be generated by parameterizing all possible combinations of wind speed/direction, wave height/period/heading, current speed/heading/profile, top tension, mud weight, vessel draft, vessel heading, etc. In addition results from predetermined models are prone to error for complex vibration phenomena such as vortex induced vibration (VIV). Predictive VIV analysis software is currently unable to accurately predict stress and fatigue due to inline vibration, higher harmonics and traveling wave behavior. Therefore, such a method is prohibitive and likely to be inaccurate when applied to riser VIV.

U.S. Pat. No. 7,080,689 ("the '689 Patent") (incorporated herein by reference for all purposes) discloses a complex system that relies on the presence of multiple sensors along the length of the riser; however, there is no provision for determining fatigue in locations at which there are no sensors. The method outlined in '689 patent requires many additional sources of data, such as: environmental data (wind, waves and current), lower marine riser package (LMRP) position, vessel position using a differential global positioning system (DGPS), and quasistatic position of the riser using acoustic beacons. This data is used in conjunction with the riser dynamic motion data, obtained from accelerometers and inclinometers at several points on the riser, to determine stresses. The numerous additional required measurements make the system prohibitive to procure, install and maintain. In addition, little is said on how stresses are obtained from the data. There is no mention of whether the stresses are computed along the entire riser length or around the circumference, nor whether stresses are only provided at sensor locations. Rather, it is curtly stated that data are "compared with results obtained by the dedicated software DeepDRiser (IFP/Principia™), or other similar software."

Software such as DeepDRiser and DeepVIV are intended for predictive analysis and not intended for fatigue monitoring. They do not take in riser motion measurements from measured vibration data as an input; instead they take in current profiles and rely on empirical relations to estimate riser stress and fatigue. Such software is limited by the assumptions that are inherent in it. For example, it is well known that most predictive VIV software analysis does not include the effect of the third and fifth harmonics of each excited frequency. In addition much of the software does not model in-line vibration and does not model traveling wave behavior well. Furthermore, the empirical data is typically not obtained from flexible risers; rather, it is obtained from rigid cylinders.

The solution suggested by the '741 patent, however, which does not rely on sensors along the length of the riser, is insufficient to address riser fatigue; it relies on the use of predetermined models, or vibration signatures, with only a few measurement locations; and that reliance results in inaccurate estimations of fatigue in the risers. The '689 patent requires many superfluous measurements and does not include software to reconstruct the stress and fatigue along the entire riser from measured motions at several locations along the riser. Instead, it makes reference to predictive software. As such, both the '741 patent and the '689 patent rely on correlating measurements to predictive analysis and are inadequate.

Since predictive analysis is limited as discussed previously, it has been found much more accurate to reconstruct the stress and fatigue along the entire riser directly from the motion of several measurements along the riser using "reconstructive software." The inventors are aware of previous attempts at reconstructive software using multiple sensors along a riser to predict fatigue damage. (See, e.g., Shi, C., Manuel, L. and Tognarelli, M. A., 2010, Alternative Empirical Procedures for Fatigue Damage Rate Estimation of Instrumented Risers Undergoing Vortex-Induced Vibration, *Proceedings of the 29th OMAE conference,* Shanghai, China, OMAE2010-20992 and Kaasen, K. E. and Lie, H., 2003, Analysis of Vortex Induced Vibration of Marine Risers, *Modeling Identification and Control* Vol. 24(2), pp. 71-85). However, accuracy of previous implementations of such methods decline as the sensor density (number of sensors per unit riser length) decreases, especially when the structure vibrates in high-order modes and exhibits traveling wave behavior.

There is a need, therefore, for method of reconstructing stress along structures that have limited sensors and undergo high-order modes and traveling waves. Various examples of the present invention are useful in, for example, (1) analysis of Vortex Induced Vibration (VIV) of marine risers, where dominant modes correspond to excited modes, (2) civil structures, to estimate loads or stresses in critical structural members or interfaces between members, and (3) automotive and aerospace vehicles, to estimate loads or stresses in critical components or interfaces.

Nothing in this document should be interpreted as a representation that a prior art search has been performed or that there are not other references that an examiner may find to be more relevant to the claims in this document. The above are merely cited as examples by way of background and are not intended to be highlighted as the most relevant references.

SUMMARY OF EXAMPLES OF THE INVENTION

Terminology and Vibration Context

The following terminology is used in the context of some example embodiments of the invention. Many of the terms and definitions refer to features of a vibration spectrum. Vibration spectra take many forms, however they generally relate the (complex-valued) amplitude of a point on a structure as a function of the frequency of vibration. The vibration spectra magnitude, when plotted on a graph, exhibit large peaks near natural (resonant) frequencies and valleys between natural frequencies. Vibration spectra can be measured using special sensors, data acquisition equipment and data processing techniques. In modern times, the time response is typically measured and recorded and the spectra are computed using software algorithms that employ the Fast Fourier Transform (FFT). Spectra can also be predicted using a mathematical model of the structure and the applied excitation. Specific definitions are:

Spectral band: a frequency band between spectral valleys, containing at least one spectral peak.

Natural frequency: One of the frequencies at which a system naturally vibrates once it has been set into motion. The natural frequency of an empirical mode is taken to be equal to the spectral peak frequency.

Modeshape: Deflected shape that a structure vibrates in when excited near or at a natural frequency. There is generally a different modeshape for each natural frequency. Modeshapes of a physical structure may be estimated from vibration measurements at many locations on a structure or by performing an eigensolution on a mathematical model of the structure.

Empirical dominant modeshape: A modeshape estimated from the measured spectral information near the natural peak frequency.

Analytical dominant mode: The analytical normal mode with frequency near the empirical natural frequency whose shape best matches an empirical modeshape.

(Analytical) normal mode: A real-valued eigenvector of the generalized eigenvalue problem involving a structure's mass and stiffness matrices.

Hilbert shape: A special basis vector obtained by taking the spatial Hilbert transform of a normal mode and then applying a window function. Hilbert shapes are useful for approximating traveling waves, when paired with their corresponding normal mode.

Candidate basis vectors: normal modes and/or Hilbert shapes that may participate in a vibration response.

Participating basis vectors: Basis vectors that are active in the vibration response (the dominant mode is always a participating mode).

To introduce a context, consider the vibration spectra of many points on a structure undergoing vibration under some external excitation. At an excitation frequency near the natural (resonant) frequency, a spectral peak exists for most of the points. The relative magnitude and phase between the (complex-valued) spectra are, to a large degree, determined by the modeshape whose natural frequency is nearest the excitation frequency. Other modes that are near the excitation frequency have a minor, but still important influence in the spectral shape near resonance. It is important to note that the entire spectrum generally has many spectral peaks, and therefore contains the influence of many dominant modes and sets of participating modes (high dimensionality). Conversely, in the vicinity of a resonant peak, only one dominant mode and set of participating modes is important (low dimensionality).

In the context of vortex induced vibration (VIV), each dominant mode, corresponding to a spectral peak is the excited mode. The other modes with nearby frequencies are the participating modes.

SUMMARY

In at least one example of the invention, vibration response is characterized by using sensors (e.g. accelerometers, angular rate sensors, a linear variable differential transformer, laser vibrometer, photogrametry sensor, velocity probe, an inclinometer, strain gauge, gyroscopes, and other sensors that will occur to those of skill in the art) to measure the vibration at several locations along a structure (e.g., a marine riser). Signals from the sensors are converted into recorded data. Such data is referred to as vibration data. Vibration data is processed and used to predict fatigue damage in the entire structure from measured data using a method of modal decomposition and reconstruction ("MDR"). In this method, a structural response of interest, such as stress and fatigue damage, is expressed by modal superposition, where the modal weights are estimated using measured data and analytical modeshapes.

It has been discovered that the accuracy decline of previous implementations of modal superposition mainly stems from the need, in the previous attempts, for the number of sensors, m, to be greater than or equal to the number of basis vectors used in the reconstruction, n. The vibration response of a structure is approximately contained within the subspace spanned by the basis vectors. The fewer basis vectors available, the more the basis vectors must "look like" the deformed shape of vibration over all time instances sampled. Because the number of vectors n is limited by m, the basis vectors must be chosen very carefully to obtain an accurate response reconstruction.

According to various examples of the present invention, an efficient methodology is provided that allows for accurate reconstruction of the riser response along the entire structure using a limited number of sensors, by increasing the ability of a limited number of basis vectors to represent the vibration of a structure.

In at least one, more specific example, a method is provided that comprises reducing the number of required basis vectors and selecting the proper set of basis vectors for each partition. In some examples, the reduction is performed by dividing the spectrum into partitions (e.g., the frequency bands) around each spectral peak, performing modal decomposition and reconstruction for each partition, and combining the results. In this way the number of basis vectors required to accurately reconstruct the vibration response is reduced by breaking up the high-dimensional problem with many spectral peaks and excited modes into a set of sub-problems of lower dimension. Partitioning the data spectrum into bandwidths is considered as a method of order reduction. The selection of candidate basis vectors is accomplished in some examples, by performing modal identification from the measured data and correlating the measured modeshape to analytical modeshapes. The candidate basis vector set is defined as the set of modes within a certain frequency tolerance from the analytical modeshape. In a more specific example, Hilbert shapes are constructed and used in the candidate basis vector set to better represent traveling wave behavior when the number of sensors is low.

At least one example includes partitioning the measured spectrum into at least one bandwidth, containing at least one dominant vibration mode, and performing modal decomposition and reconstruction separately for each spectral band. This allows use of several (up to m) participating modes in each bandwidth partition (rather than up to m participating modes in the entire spectral bandwidth), and thus improve the accuracy.

Stress distribution has been found to be sensitive to the chosen set of participating basis vectors; therefore, some examples include optimizing over several subsets of the candidate basis vector set. In the process, data from at least one sensor is omitted. Data is then reconstructed at the omitted sensors. The set of basis vectors that results in the lowest error between measured and reconstructed data at the omitted sensors is selected as the participating basis vector set. If sensors are omitted one at a time, there can be up to (m−1) participating modes in each frequency band.

In examples in which complex modes (e.g., traveling waves) are to be reconstructed, the modeshapes are augmented with additional basis vectors. The additional basis vectors are obtained, for example, by shifting the phase of the normal modes by 90 degrees at every wave number using the Hilbert transform and applying a spatial windowing function.

A spectral method for fatigue damage estimation greatly reduces the computational expense by supplanting the costly time domain cycle counting step with closed-form formulae. In addition, MDR is performed using several (typically no more than 4) matrices of small size (m×m) instead of the large data arrays of time series and/or Fourier coefficients. Computer memory usage is also greatly reduced as a result.

Various examples of the present invention are useful in, for example, (1) marine risers, to estimate fatigue due to Vortex Induced Vibration (VIV) of marine risers, where dominant modes correspond to excited modes, (2) civil structures, to estimate loads or stresses in critical structural members or interfaces between members, and (3) automotive and aerospace vehicles, to estimate loads or stresses in critical components or interfaces. The method can also be used to estimate deflection as needed in clashing and interference analysis of a set flexible structures (e.g. marine risers on a drill ship and solar arrays on a satellite) or velocity as is important in piping system analysis.

The above has been given by way of example only. Nothing in this summary is intended to limit or expand the scope of the claims in this document to interpretations include only the listed examples.

DETAILED DESCRIPTION OF EXAMPLES OF THE INVENTION

Figure 1:
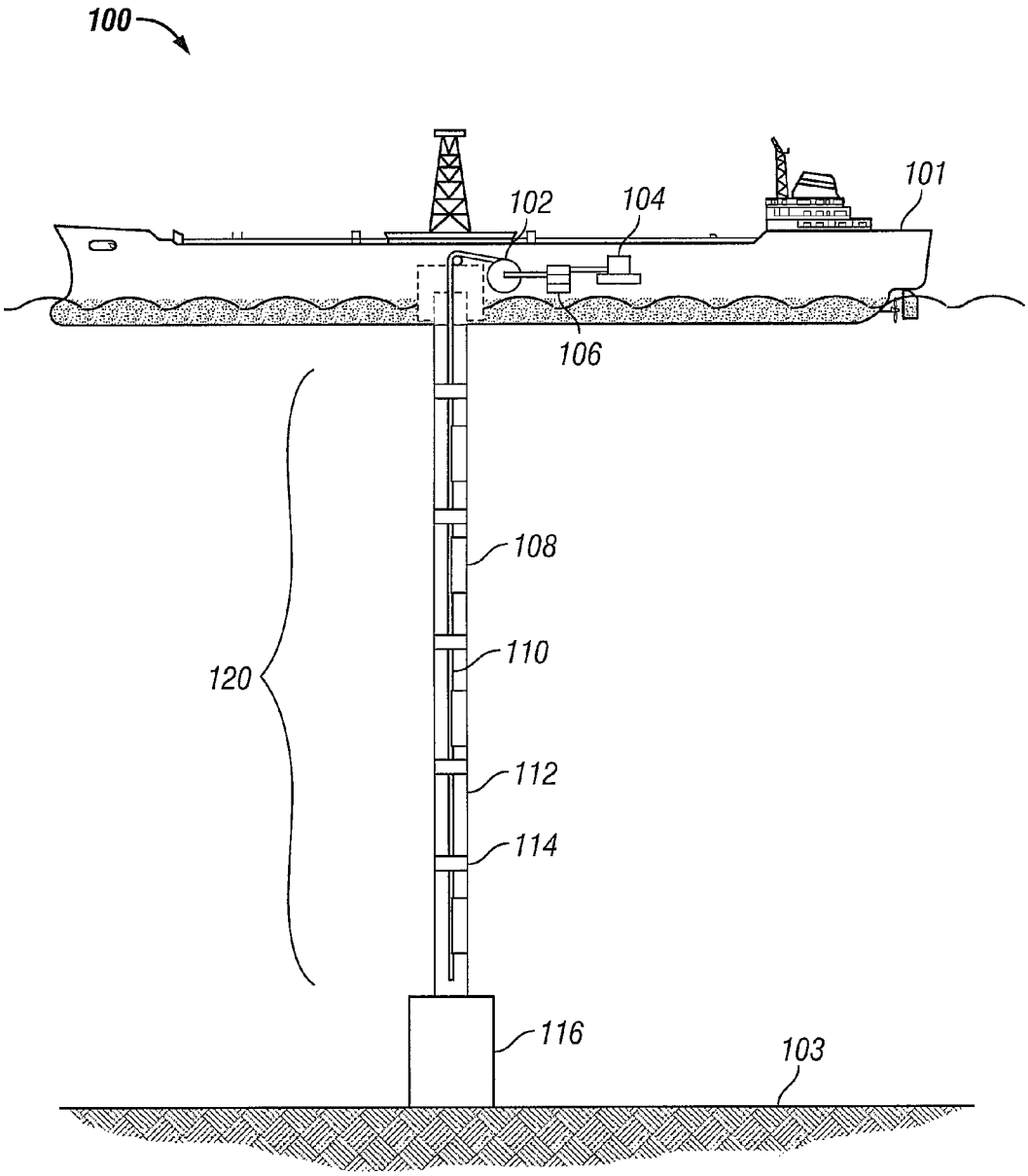
FIG. 1 is a perspective view of the general layout of a vessel and marine riser with an instrumentation system.

In FIG. 1, a deep water system 100 is seen in which a riser 120 is attached between a floating vessel 101 and the seabed 103. The system on vessel 101 comprises the following components: cable handling system 102, data acquisition and processing unit ("DAPU") 106, and server 104. In the example seen, riser 120 comprises the riser conduit 112, cable riser clamps 114, riser cable assembly 110, and subsea vibration data logger ("SVDL") units 108. At the seabed 103, riser 120 is connected to a blow-out preventer and lower marine riser package ("LMRP") assembly 116. Multiple SVDL units 108 sample motion sensors (e.g., accelerometers and angular rate sensors) that are placed on riser conduit 112 at sensor locations along riser 120.

Figure 2:
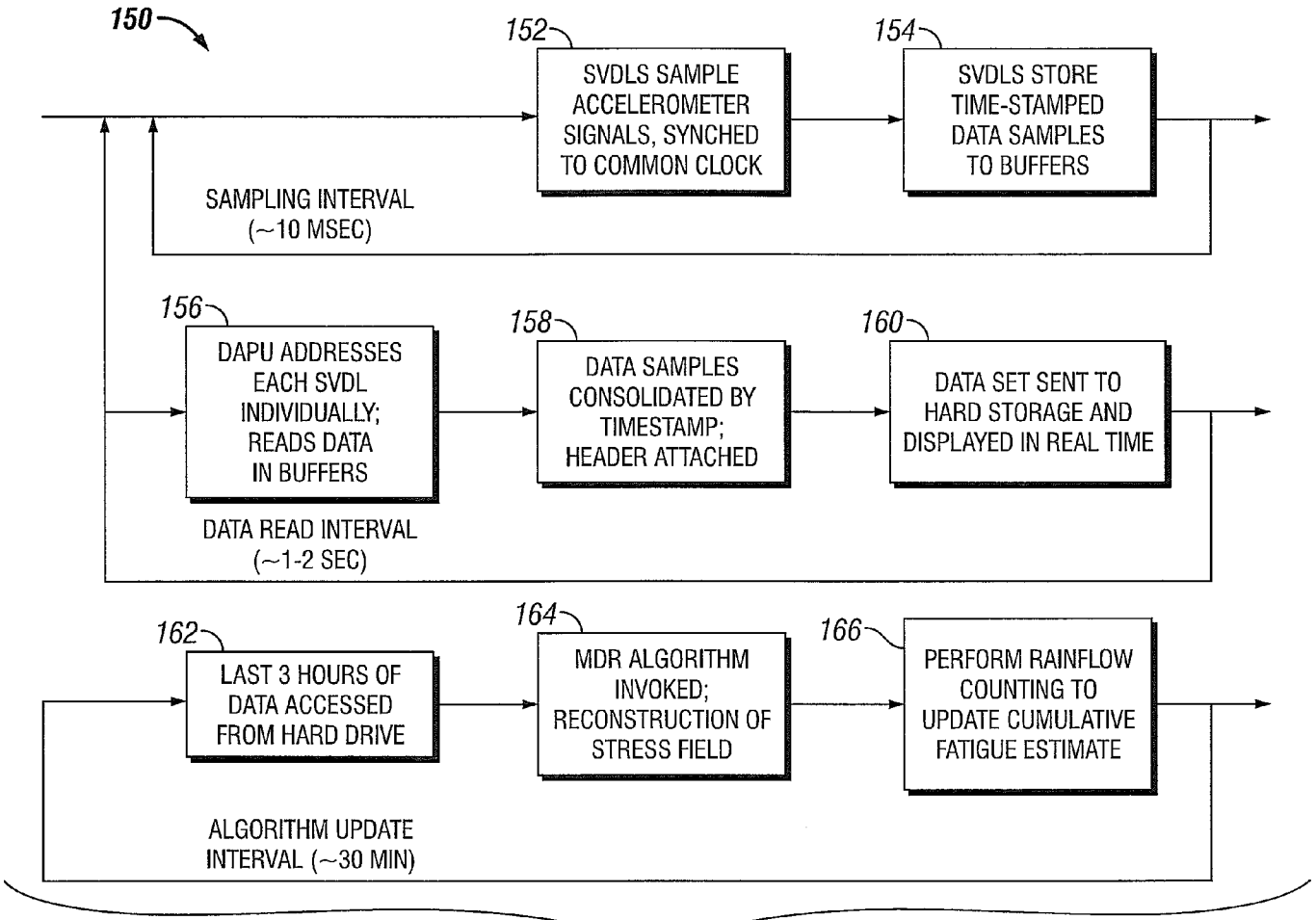
FIG. 2 is a flow chart of an example method of data collection and estimation of riser stress and fatigue.

FIG. 2 illustrates a method 150 used according to an example of the invention, in which SVDL units 108 samplemotion sensor signals at about a 10 millisecond sampling interval, synchronized (shorthand "synched" shown in FIG. 2 to a common clock, at step 152 and the SVDL units 108 store time-stamped data samples to memory buffers at step 154. The DAPU 106 addresses each SVDL unit individually, reading the data in the buffers, at step 156. DAPU 106 then consolidates the samples by time stamp and attaches headers at step 158; the resulting data set is sent to hard storage and displayed in real time at step 160.

In at least one example at step 162, server 104 reviews the last 3 hours of data accessed from the hard drive at an update interval of about 30 minutes; at step 164, server 104 runs a modal decomposition and reconstruction algorithm to reconstruct a stress field. Rainflow counting updates a cumulative fatigue estimate at step 166.

By using examples of the disclosed method, fine spatial resolution in the bottom 1000 feet and top 1000 feet of a typical riser can be obtained along with coarse spatial resolution in the remainder of the riser, which significantly reduces software run time.

In at least one example, server 104 comprises an HP DL370 G6 SFF using and Intel Xeon processor, with between about 4 GB and about 192 GB RAM, between about 1.1 TB and about 14 TB storage capacity, RAID 1 for OS protection (2HDD), RAID 5 for DATA protection (3HDD). In further examples, server 104 also comprises 2 standby hard drives, and an additional power supply for redundancy. Acceptable software components include a Windows XP operating system, LabVIEW graphical user interface (GUI) with a hardware communication interface, Matlab data processing and analysis routines, a file server to store data files, and an FTP client to transfer data files from real-time communications controllers.

Figure 3:
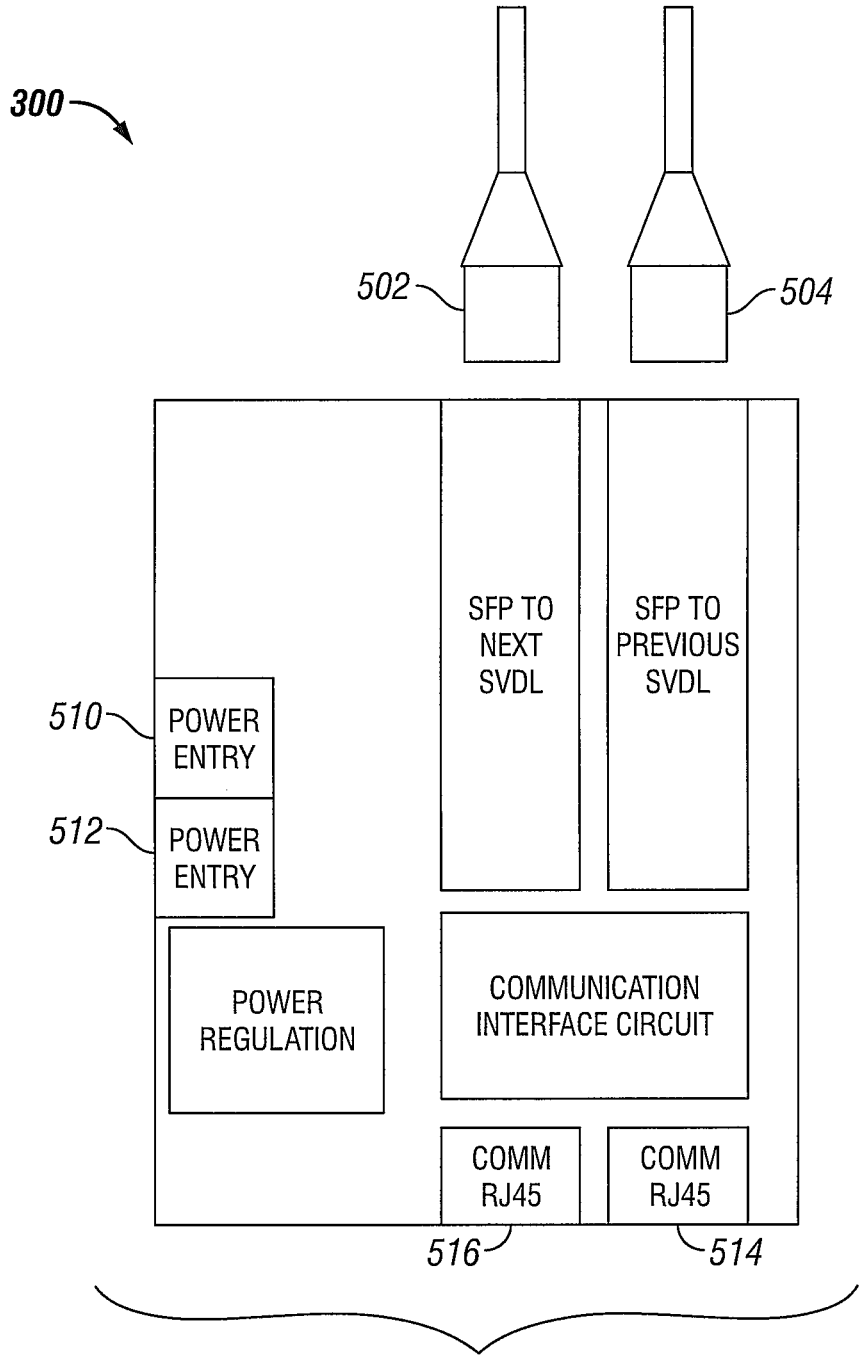
FIG. 3 is a block diagram of an example fiber optic transceiver.

FIG. 3 illustrates an example fiber optic transceiver for use in DAPU 106 and SVDL 108, wherein RS485 connections (or other digital serial connections) are made to the fiber transceiver through SFP connections 502 (to the next SVDL in line and 504 to the previous SVDL or vessel) with point-to-point and/or multi-drop capability using master-slave commands. Redundant power inputs 510 and 512 are also supplied, as are redundant communication connections 514 and 516 (Rx/Tx; RJ45 to DAPU controllers or SVDL electronics, having a maximum of 1.5 Mbps communication speed). No further description is required for a person of ordinary skill in the art to make and use such transceivers.

Figure 4:
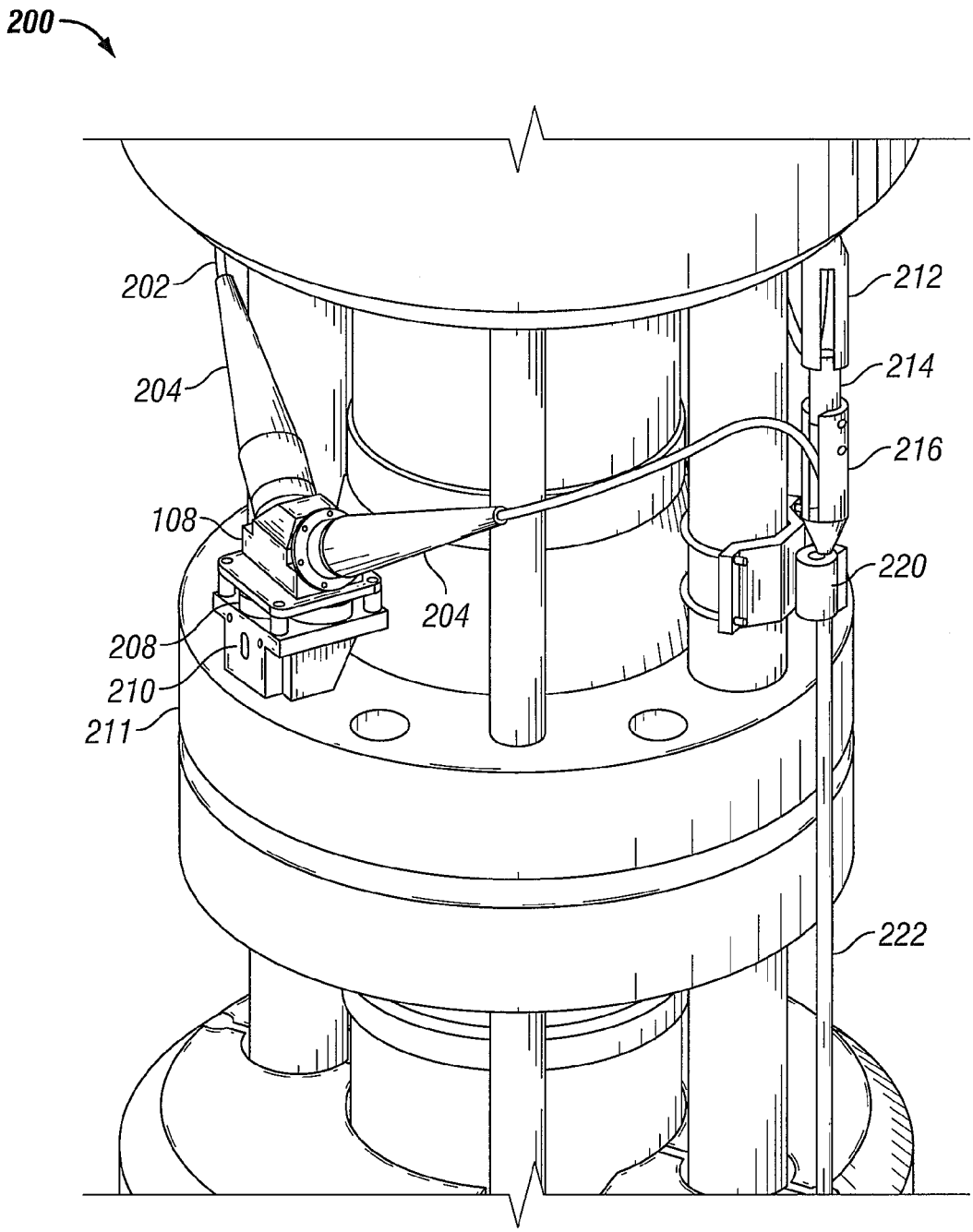
FIG. 4 is a perspective view of an example subsea vibration data logger ("SDVL") location and cable arrangement.

FIG. 4 illustrates a mechanical configuration for an example SVDL location, where upper cable 202 is connected with connector 204 to SVDL unit 108, which is connected to riser flange 211 by a lock nut 208 and spacer block 210 in a manner known to those of skill in the art. A lower cable 222 is also connected to SVDL unit 108 through a separate connector 204. The cables 202 and 222 are armored between SVDL units along riser 120, and clamped at the SVDL unit location by a cable clamp 220 where lower cable armor termination component 216 is connected by a swivel 214 to upper cable armor termination component 212, as is commonly known in the art.

Figure 5B:
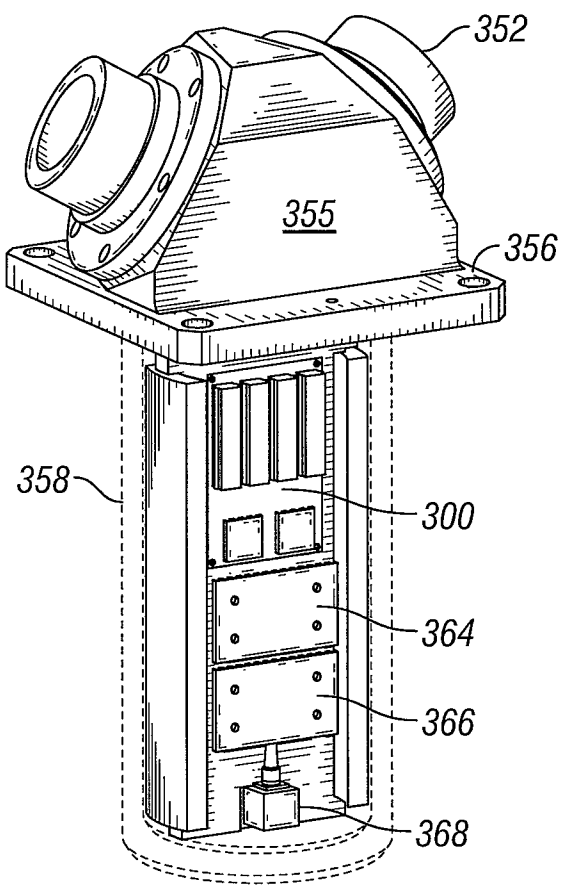
FIGS. 5A and 5B are perspective views of an SVDL housing and contents.
Figure 5A:
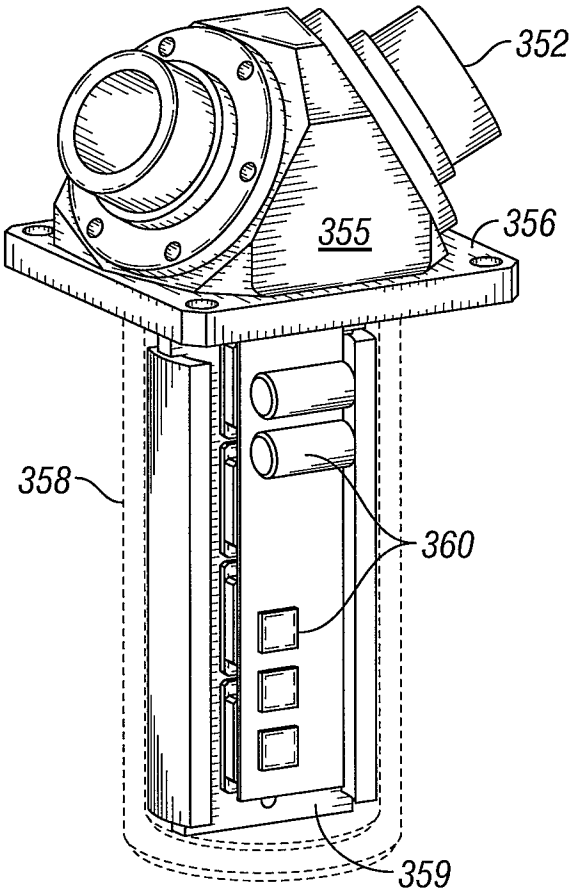

FIG. 5A illustrates the internal layout of an acceptable SVDL having a pressure housing 358, holding a printed circuit board 359 on which power electronics 360 are mounted. FIG. 5B illustrates the opposite side of housing 358, to which sensor 368 (for example, an accelerometer and/or angular rate sensor) is mounted and connected to analog board 366, which is connected in turn to digital board 364. Signals from digital board 364 are sent to fiber optic conversion circuits on transceiver board 300 for transmission on fiber optic lines (not shown). Example SVDL units 108 include an upper end-cap 355 that includes electro-optical receptacles 352 and an external mounting surface 356. The end-cap 355 mates with pressure housing 358, which is made, for example, from 316 stainless steel, 17-4 PH stainless steel, super duplex, or other materials that will occur to those of skill in the art.

Figure 6:
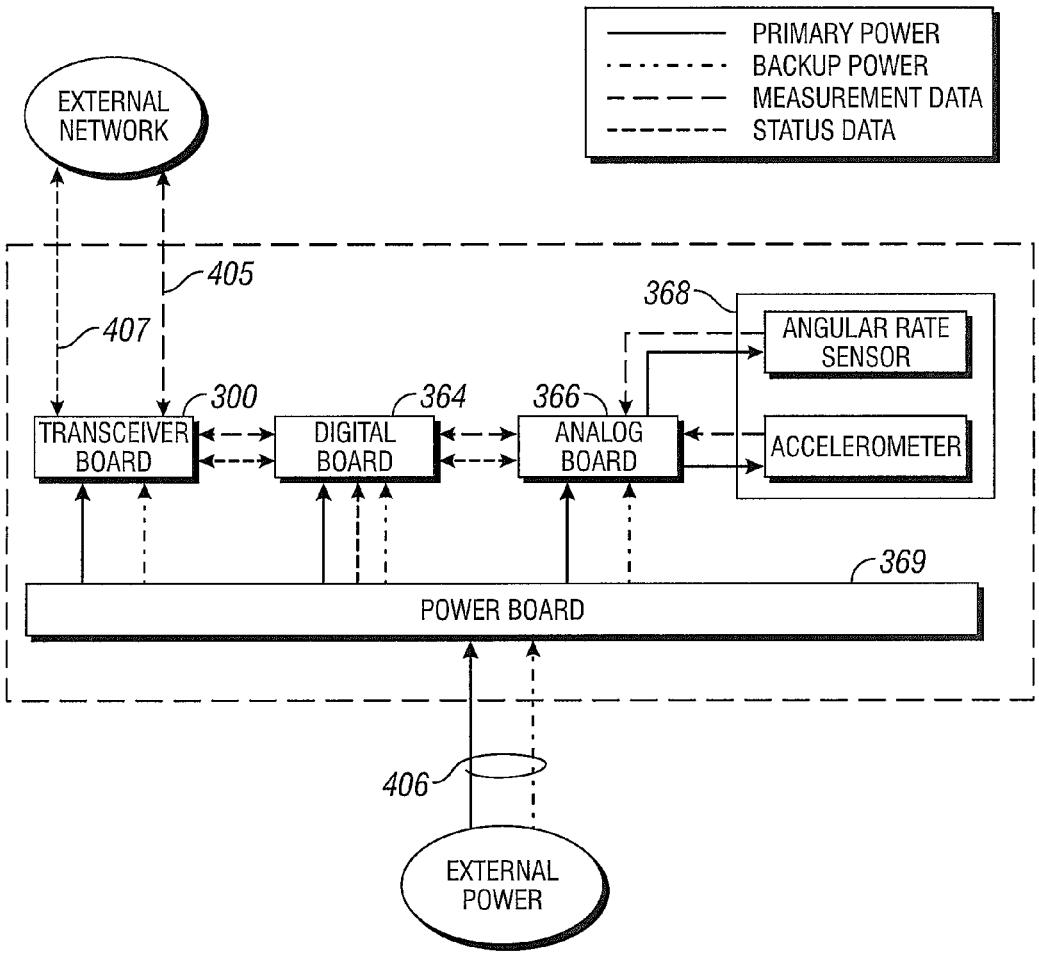
FIG. 6 is a block diagram of an example SVDL internals.

FIG. 6 shows a schematic diagram of the interior arrangement of SVDL unit 108, where sensor data is passed from sensor 368 to SVDL analog board 366 for filtering, which is connected in turn to digital board 364 for signal digitization, buffering, and communication with the DAPU, as is commonly understood by those of skill in the art. On transceiver board 300, optical/electrical signal conversion occurs. Power board 369 handles power conditioning from redundant power lines 406. Fiber optic measurement data line 405 and fiber optic status data line 407 connects transceiver board 300 to the DAPU. The connection made through hybrid connector bulkheads 352 (see FIGS. 5A and 5B), which also connect to fiber-optic signal pass-through lines (seen schematically in FIG. 8 and accompanying text) allowing other SVDL units to be connected to the vessel. Internally, SVDL units convert a 200 VAC power signal to 12 VDC for powering electronics.

Figure 7:
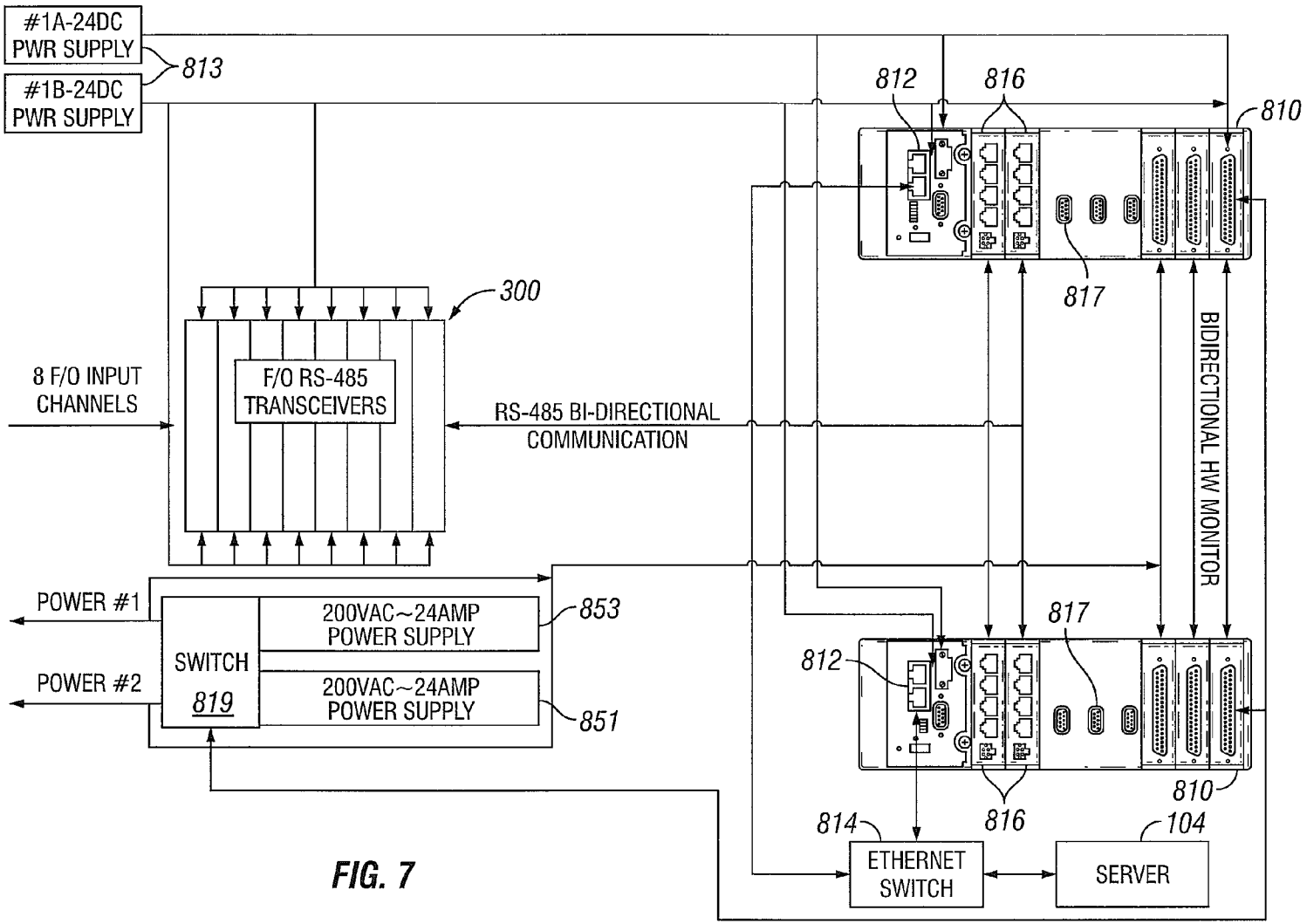
FIG. 7 depicts a schematic configuration of an example data acquisition and processing unit ("DAPU").

FIG. 7 depicts an example hardware configuration of the DAPU 106. Example acceptable communications controllers 810 include redundant cRIO real-time PowerPC controllers comprising a 533 MHZ processor, 2 GB storage, 256 MB DDR2 memory. Some examples include dual Ethernet ports 812 for connection to file server 104 and web access through Ethernet switch 814 and dual power inputs for redundant power supplies. A −20 to 55 C operating temperature range is acceptable. Fiber optic transceiver cards 300 communicate with controller units 810 through RS485 cards 816. The controller digital I/O 817 provides for power switching control and health monitoring of external components (e.g., analog inputs to monitor SVDL current, SVDL power supplies 851 and 853, Ethernet switch (not shown), other topside components that will occur to those of skill in the art). For example, in the event of a power fault of SVDL power supply 851, digital I/O 817 activates switch 819 to disconnect power supply 851 and connect power supply 853. Redundant DC power supplies 813 supply 24 DC power to the electronic boards as shown.

Referring again to FIG. 1, locations for SVDL units 108 along a riser 120 are chosen based on nodal kinetic energy calculations from analytical mode shapes and vibration fatigue analysis of riser 120 that are known to those of skill in the art and require no further disclosure (e.g., SHEAR7, using an typical riser configuration for about seven thousand feet of water, with mud weight of about 1.25 specific gravity and top tension of about 1944 kips). Candidate nodes are at locations of flanges. In at least one such example, seven locations are chosen as follows:

(1) 185.3 feet from the seabed, at the top of a centralizer joint because, for most of the cases analyzed, a critical point was found at 185.3 feet; also, for cases with lowest tension, a fatigue critical point was found at 146.2 feet or 139.8 feet.

(2) 365.3 feet of elevation, at a lower slick joint, two joints above the centralizer joint; nodal kinetic energy (KE) was found to be highest at such a node. It is also considered desirable to have an additional sensor near bottom, since the fatigue critical point is always near the bottom.

(3) 995.3 feet of elevation, at a lower slick joint, one joint below a pup joint. Nodal KE was found to be high at this location, and it was desired to have three sensors in the bottom 1000 feet where high stress response and curvatures occur; further, in the example riser configuration, there is a pup joint at 1085 feet, and it is desirable to avoid that joint.

(4) 2543.3 feet, at a buoyed joint, and (5) 4165.3 feet, at a buoyed joint; where locations (4) and (5) were chosen to have two sensors at about uniform spacing from location (3) and the next node where KE was calculated to be high (location (6) below).

(6) 5695.3 feet, at buoyed joint, chosen to have two spaced sensors in the top portion of the riser system and because KE is relatively high and stress for two representative SHEAR& cases was seen to be close to a maxima.

(7) 6235.3 feet, and the topmost joint, chosen to be close to the top boundary where KE is at a local maxima, below the termination joint.

As illustrated above, acceptable choices for sensor location include those nodes having the highest nodal kinetic energy and locations at or near fatigue critical points. Other considerations for sensor location include: accessibility and operational constraints that will occur to those of skill in the art.

Figure 8:
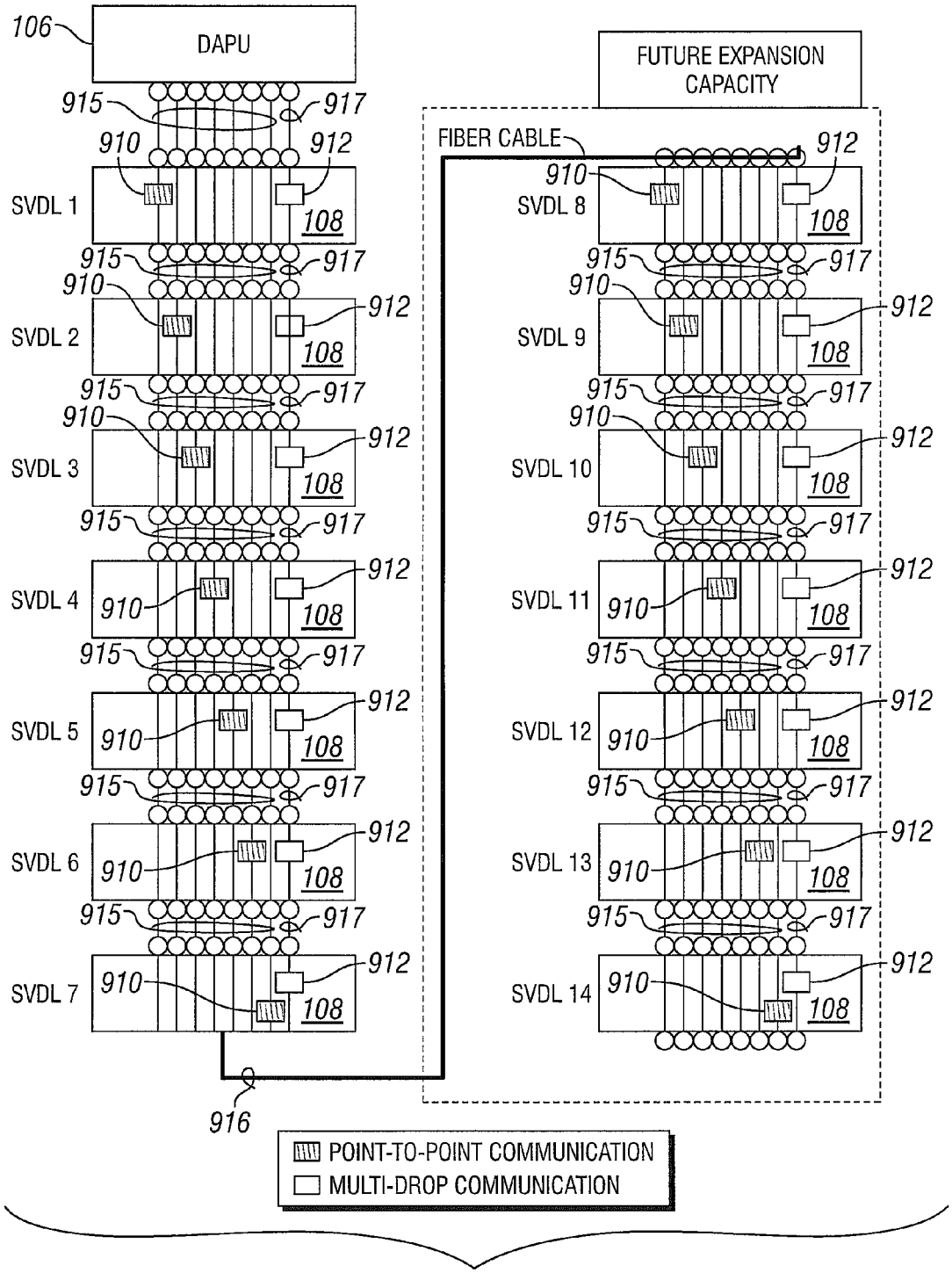
FIG. 8 illustrates a data communication schematic.

Acceptable accelerometers have the following specifications:

Tri-axial configuration (three mutually orthogonal sensitive axes)
Frequency response: 0 to 250 Hz
Range: ±2 g, each axis
Sensitivity: 2000 mV/g
Resolution: 350 micro-g (0.000350 g)
Amplitude non-linearity: <1.0% full-scale Acceptable angular rate sensors will have the following specifications:

Range: ±200 degrees/sec
Resolution: 0.0025 degrees/sec
Frequency response: 0 to 100 Hz
Noise density: 0.0017 degrees/sec/$Hz^{0.5}$
Sensitivity: 0.025 V/degree/sec Referring again to FIG. 1, the SVDL units 108 are connected through cable handling system 102 on vessel 101, in some examples, by fiber optic networks that will occur to those of skill in the art. One acceptable communication specification is seen in FIG. 8, where seven SVDL units are connected in a fiber optic star configuration to DAPU 106 through point-to-point communication connections 910 and backup multi-drop connections 912. Primary communication is provided with RS485 transceiver boards (e.g., boards 300 of FIG. 7 and 300 of FIG. 3) at a maximum speed of 1.5 Mbps through primary fiber connections 915. Other maximum speeds will occur to those of skill in the art. Secondary or backup communication is performed through multi-drop (daisy chain) connections 912 over backup fiber connection 917. Expansion capacity is provided through fiber connection 916 to seven additional SVDL units that are also configured with a hybrid star/daisy chain pattern for primary communication and daisy chain for secondary communication.

Figure 9:
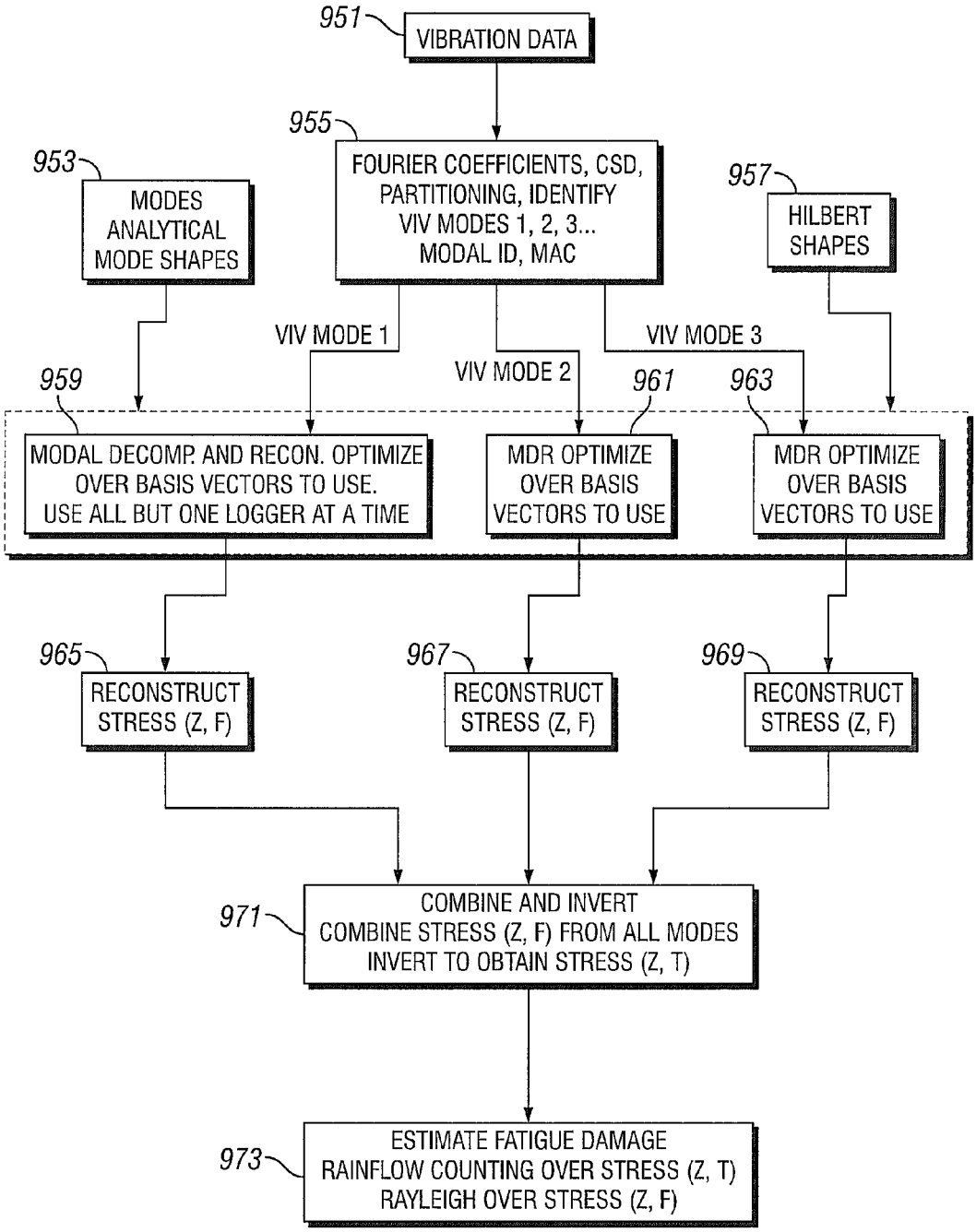
FIG. 9 is a flow chart of an example calculation of stress and fatigue damage throughout an entire riser.

In FIG. 9, a flow chart of a method with examples of systems such as described above is seen, in which vibration data is acquired from locations on a riser in block 951. Analytical normal mode shapes are provided at block 953, and Hilbert shapes are determined at block 957. The analytical mode shapes are determined, for example, from inputs of riser configurations, including space-outs, tensions, and mud weights, from which traditional modes analysis is performed to generate a database of potential mode shapes for the riser configuration used in practice, as is commonly known to those of skill in the art. Hilbert shapes are obtained for each normal mode, for example, by taking the Hilbert transform and applying a window function. Further details on construction of Hilbert shapes are discussed elsewhere in this document.

At block 955, Fourier coefficients and cross spectral density (CSD) functions are computed from measured time domain data, spectral partitioning is performed and empirical excited modal parameters are identified within each partition. Stored analytical modal parameters are compared to the identified empirical modal parameters using correlation techniques such as the modal assurance criterion (MAC) to determine the corresponding analytical excited mode in each partition as is known to those of skill in the art. From that analysis, a plurality of excited modes is chosen (here, three). At least one analytical excited mode is used, along with other candidate basis vectors (normal modes and Hilbert shapes), in block 959 in a modal decomposition and reconstruction process with data for all SVDL units except one, optimizing which basis vectors to use, resulting in an output of the optimal set of participating basis vectors. In block 961, and MDR process is used with a second set of candidate basis vectors and the second spectral partition, resulting in a second optimal set of participating basis vectors. And similarly for block 963. In blocks 965, 967, and 969, a set of reconstructed stress Fourier coefficients (frequency domain stresses) is obtained along the entire riser. The stresses are obtained by performing MDR using each of the three sets of optimized basis vectors using methods similar to those described later in this document. The reconstructed stress Fourier coefficients are used as inputs to block 971, where the stress reconstructions from each spectral partition are combined and inverted to obtain stress in the time domain along the entire riser. From that result, fatigue damage is assessed in block 973 through rainflow counting over the time domain stress and Rayleigh damage calculations using the stress Fourier coefficients, as is known to those of skill in the art (see, e.g., Benasciutti, D., 2004, Fatigue Analysis of Random Loadings, Ph.D. Dissertation, Department of Civil and Industrial Engineering, University of Ferrara, Italy.), for example.

In at least one example, a method for determining fatigue in a structure from stress data comprises: identifying spectral peaks and spectral bands in structure's measured vibration spectrum, extracting, for each spectral band, a natural frequency and a modeshape of the empirical dominant mode (excited mode in the VIV context), determining a corresponding natural frequency and modeshape of an analytical dominant mode for each empirical dominant mode, defining a set of candidate basis vectors, defining a set of participating basis vectors as that a set of basis vectors, taken from the candidate basis vectors, that results in the lowest prediction error at omitted sensor locations, and repeating the above steps for each independent direction of vibration.

In further examples, the method also includes one or more of the following steps: estimating generalized displacement; estimating acceleration data at sensor locations due to vibrations; determining, from generalized displacements and participating basis vectors, stress data at desired locations; and computing fatigue damage information from the determined stress data at the desired locations.

In some examples, defining a set of participating basis vectors comprises performing multiple decompositions and reconstructions with subsets of candidate basis vectors while omitting the data from a single sensor, one omitted sensor at a time. In at least one such example, the performing of each decomposition and reconstruction comprises reconstructing acceleration data at each omitted sensor location and comparing the reconstructed acceleration data to measured acceleration data from the same omitted sensor.

In some examples, the method also includes the acquisition of measured vibration data samples and the computation of spectral moments from the measured vibration data. In some further examples, cross-spectral moments are computed from the measured vibration data.

In some such examples, the performing of the decomposition and reconstruction comprises a spectral method, while in further examples, the performing of the decomposition comprises a hybrid time-domain/frequency-domain method.

In at least one hybrid time-domain/frequency-domain (spectral) method. Time series structural motion data is collected and converted to the frequency-domain (e.g., Fourier coefficients and smooth cross spectral density (CSD)) is computed from the Fourier coefficients. The smooth CSD function is computed in some examples as discussed elsewhere in this document. Modal identification is performed on the CSD data to determine dominant modes. Modal decomposition and reconstruction (MDR) is performed on Fourier coefficients, using the participating basis vectors, to determine the stress at desired locations in the structure. Stress Fourier coefficients are converted back to the time-domain by inverse fast Fourier transform (IFFT). In at least one such example, time-domain fatigue methods, e.g. rainflow cycle counting (see, e.g., Benasciutti, D., 2004, Fatigue Analysis of Random Loadings, Ph.D. Dissertation, Department of Civil and Industrial Engineering, University of Ferrara, Italy), are then performed to estimate fatigue damage.

In an example spectral method of performing the decomposition and reconstruction, which is much more computationally efficient than the hybrid-domain/frequency-domain method, time series structural vibration data is collected and converted to the frequency-domain Fourier coefficients. Smooth cross spectral density is computed from the Fourier coefficients. The smooth CSD functions are computed as discussed elsewhere in this document. Fourier coefficient and CSD data are partitioned into bandwidths surrounding dominant modes. For each partition the following is done: Modal identification is performed using the CSD partitions to determine dominant mode. Several (typically, no more than four) spectral cross-moment matrices are formed. The matrices are small in dimension (no greater than m×m). Large arrays of time series and Fourier coefficient vibration data are no longer needed and may be cleared from computer memory. MDR is performed on the set of matrices to estimate several (typically, no more than four) stress spectral auto-moments at desired locations in the structure. Spectral fatigue methods are then employed to estimate fatigue damage.

In other examples of the invention, the modal identification is performed on the Fourier coefficients using methods which are known to those skilled in the art. Such methods include: peak-picking, circle fitting methods, single degree of freedom fitting methods, Rational Fraction Polynomial Method and Polyreference Frequency Domain Method.

In other examples of the invention, modal identification is performed on time series data using time-domain methods which are known to those skilled in the art. Such methods include: Eigensystem Realization Algorithm, Ibrahim Time Domain Method, Multiple Reference Time Domain Method and Polyreference Time Domain Method.

In a more specific example of the invention, vibration data is measured by instruments attached to a riser and presented in the form of a discrete time sequence of vibration data samples. As used in the remainder of this example, acceleration is presumed to be the form of the measured vibration data and stress and fatigue are considered to be the desired responses. The empirical (measured) acceleration vector is denoted as $\ddot{x}^e(t_k)\epsilon R^m$, where $t_k$ is discrete time and $k=\{1, 2, \ldots, K\}$.

In at least one hybrid time domain/frequency domain example, measured vibration Fourier coefficients are computed, The Smoothed Cross Spectral Density (CSD) matrix, $C(\omega)\epsilon C^{m\times m}$ is computed. In some examples, the Fourier coefficients and smoothed CSD is computed via algorithms that employ the Fast Fourier Transform (FFT) of the data, $$a^e(\omega_k)=FFT\{\ddot{x}^e(t_k)\} \tag{1}$$

where, $a^e(\omega_k)\epsilon C^m$.

In one example, the smooth CSD is computed by frequency domain averaging as in the Matlab® function attached in appendix A, spec_smooth.m.

Alternatively, in at least one spectral example, a matrix of the $p^{th}$ order spectral cross-moments of the measured accelerations is denoted by $M_a^{(p)}\epsilon R^{m\times m}$. The $ij^{th}$ element of the matrix is computed by, $$m_{aij}^{(p)} = \frac{1}{2}\mathrm{Re}\left\{\sum_k f_k^p a_i^*(\omega_k)a_j(\omega_k)\right\}, \tag{2}$$

where $f_k$ is the frequency in Hertz and $(\bullet)^*$ is the complex conjugation. The set of matrices for $p=\{0, 1, 2, \ldots, P\}$ is computed. For most spectral fatigue methods, P is less than or equal to 4.

Regardless of whether a hybrid or spectral method is used, spectral peak detection and spectral bandwidth partitioning is then performed. In at least one such example, a data point on the spectrum is considered a peak if it attains a local maximal value, is preceded (somewhere to the left), and is succeeded (somewhere to the right) by a data point having a value that is lower by δ dB (typically 4-5 decibels). The preceding and succeeding valleys (minima between peaks) are used to define the bounds of the spectral band corresponding to a spectral peak. In some cases, the beginning and end of the data set are considered valleys. In at least one embodiment, the diagonal elements of the CSD matrix are averaged for determining spectral peaks and partitions.

Modal identification from measured data is also performed. In at least one example, modal identification is performed using the measured CSD data. The empirical natural frequency, $\omega^e_{ni}$, (the subscript n denotes the natural frequency and the subscript i represents the $i^{th}$ peak), is taken as the spectral peak frequency, $\omega_p$. The modeshape, $\psi_i\epsilon C^{m\times 1}$ is estimated as the principal eigenvector, $u_i$, of the CSD matrix evaluated at the peak frequency, $$\psi_i=u_i,$$

where $$C(\omega_p)u_j=\lambda_j u_j, \tag{3}$$

$$\lambda_i\geq\lambda_j,\ j=\{1, 2, \ldots, m\}$$

$C(\omega_p)$, is Hermetian; therefore its eigenvalues $\lambda_j$ are real-valued, and eigenvectors $u_j$, are generally complex-valued, resulting in identification of complex empirical modes.

Modeshape correlation is performed, in at least some examples, by identifying the analytical dominant mode as the mode that best matches the shape of the empirical dominant mode, for example, by using a Modal Assurance Criterion (MAC) as a measure of shape correlation. Other measures such as the Cross-Orthogonality can also be employed. The MAC is given by, $$MAC_{ij} = \frac{(\psi_i^T\varphi_j)^2}{\|\psi_i\|^2\|\varphi_j\|^2}, \tag{4}$$

Where $\psi_i$ is the $i^{th}$ empirical modeshape, $\phi_j$ is the $j^{th}$ gravity corrupted (if needed) analytical modeshape and $\|\bullet\|$ is the vector 2-norm. The MAC value ranges between 0 (no correlation) and 1 (perfect correlation). The analytical dominant mode is defined as the analytical mode with the highest MAC value, resulting in the analytical dominant (excited in the context of VIV) natural frequency, $\omega^{ex}_{ni}$, and modeshape, $\phi^{ex}_i$.

Once the analytical dominant mode is found, a set of candidate basis vectors (set of basis vectors from which participating modes are taken) are defined. The candidate linear displacement normal modes, $\Phi_c$, are taken as the r modes with frequencies nearest, $\omega^{ex}_{ni}$, where r is a defined parameter. The corresponding candidate linear displacement Hilbert shapes, $\Theta_c$, are computed (as discussed elsewhere in this document) for the first s of these modes (those with minimum frequency difference from the analytical dominant mode), where s is a defined parameter. Note that $r+s\leq m-1$ (one sensor will be omitted later on) to estimate the generalized responses. Similarly, the candidate rotational modes and Hilbert shapes are $\Phi_c^{rot}$ and $\Theta_c^{rot}$, respectively. Because the empirical data consists of gravity corrupted accelerations, the candidate basis vectors corresponding to the normal modes, $V_c^n$, and Hilbert shapes, $V_c^H$, are, $$V_c^n=-(\omega_{ni}^e)^2\Phi_c-g\Phi_c^{rot},$$

$$V_c^H=-(\omega_{ni}^e)^2\Theta_c-g\Theta_c^{rot}. \tag{5}$$

Participating basis vectors are taken from the set of candidate basis vectors.

In selection of participating basis vectors, the error between reconstructed and measured accelerations at the sensor locations is reduced by increasing the number of participating basis vectors; however, the error at positions without sensors can be large. Therefore, it is desirable to choose the set of participating modes such that the prediction error is low at locations without sensors. A straight forward way to accomplish this is to perform several decompositions using subsets of the candidate basis vectors while omitting the data from a single sensor, one omitted sensor at a time. Acceleration is reconstructed at each omitted sensor location and compared to the measured acceleration.

In a hybrid method, where $(\bullet)^+$ denotes the generalized inverse, an acceptable set of steps comprises:

1. Take the first j candidate Hilbert basis vectors, where $j=\{0, 1, \ldots, s\}$, to obtain the test set of Hilbert shapes, $V_t^H$.
   Do the following for each set of Hilbert shapes:
2. Take the first k candidate modes, where $k=\{1, 2, \ldots, r\}$, to generate the test set of normal modes, $V_t^n$. Construct the test set of basis vectors, $V_t=[V_t^n, V_t^H]$.
   Do the following for each set of normal modes:
3. Omit the acceleration data from the $l^{th}$ sensor to obtain the data set of included sensors, $a_i^e(\omega_k)$.
   Do the following for each set of included data:
   * Partition $V_t$ to the omitted sensor and the included sensors, yielding $v_t^o$ and $V_t^i$, respectively.
   * Decompose the included accelerations into the generalized displacements, $$q(\omega_k)=(V_t^i)^+a_i^e(\omega_k). \tag{6}$$

* Reconstruct responses at the omitted sensor location, $$a_o^r(\omega_k)=v_t^o q(\omega_k). \tag{7}$$

* Compute the prediction error for the omitted sensor, $$e_o(\omega_k)=a_o^r(\omega_k)-a_o^e(\omega_k) \tag{8}$$

* Compute the RMS prediction error for the omitted sensor, $$e_o^{RMS}=\sqrt{\frac{1}{2}\sum_{k=1}^{K}|e_o(\omega_k)|^2}. \tag{9}$$

* Impose a penalty on the error if the reconstructed response under predicts the measured response by multiplying the RMS error by a factor (e.g. 5).
   * Sum the RMS error over each omitted sensor to obtain the prediction error for the test basis, $e^{RMS}$.
4. The test basis resulting in the lowest prediction error is selected as the set of participating basis vectors, for the $i^{th}$ VIV band, used for final decomposition and reconstruction using all the sensor data, $V_f$. The normal modes and Hilbert shapes comprising the basis are considered to be the participating modes.

In a spectral method, where $(\bullet)^+$ denotes the generalized inverse, the process proceeds similarly, with the exception that Fourier coefficient data, $a^e(\omega_k)$, is replaced by the set of acceleration cross-spectral moment matrices, $M_a^{(p)} \in R^{m-1\times m-1}$, and matrix transformation replaces vector transformation. Note that the dimension is now $(m-1\times m-1)$ because one sensor is omitted. The index p is the order of the spectral cross-moment.

* The decomposition step becomes, $$M_q^{(p)}=(V_t^i)^+M_a^{(p)}(V_t^i)^{+T}. \tag{10}$$

* The reconstruction step becomes, $$m_{a\,oo}^{(p)}=v_t^o M_q^{(p)} v_t^{o\,T}. \tag{11}$$

In the above equation, $m_{a\,oo}^{(p)}$ is the $p^{th}$ spectral moment of acceleration at the $o^{th}$ omitted sensor location.

* An appropriate error measure, replacing the RMS error, can take the following form, $$e_o^{spec}=\sum_{p=1}^{P}\alpha_p m_{aoo}^{(p)}. \tag{12}$$

In the above equation, $\alpha_p$ is a weighting factor for the $p^{th}$ spectral moment.

* The error can be summed over each omitted sensor to obtain the prediction error for the test basis, $e^{spec}$.

This entails sufficient mathematical details required for person of ordinary skill in the art to practice this embodiment.

Response reconstruction is performed in a hybrid example embodiment as follows.

After the appropriate basis is obtained, the generalized displacements in the $i^{th}$ frequency band are estimated in a final decomposition step by, $$q(\omega_k)=(V_f^s)^+a^e(\omega_k). \tag{13}$$

Here $V_f^s$ is the final basis partitioned to the sensor DOF. Note that data from all sensors is included at this stage. Then stresses are reconstructed at the desired positions and angles along the circumference by, $$\sigma^r(\omega_k)=\Phi^\sigma q(\omega_k). \tag{14}$$

The matrix is the set of participating stress modeshapes. Accelerations are also reconstructed at the sensor locations to compare to the measured accelerations, $$a^r(\omega_k)=V_f^s q(\omega_k). \tag{15}$$

Response reconstruction is performed in a spectral example embodiment as follows.

After the appropriate basis is obtained, the generalized displacements in the $i^{th}$ frequency band are estimated by solving the equation, $$M_a^{(p)}=V_f M_q^{(p)} V_f^T. \tag{16}$$

Here, $M_q^{(p)}$ are the matrices of generalized (modal) spectral cross-moments and the superscript s has been dropped from $V_f^s$ for clarity. The matrices $M_a^{(p)}$ are easily computed from measured data. Note that data from all sensors is included at this stage, such that $M_a^{(p)} \in R^{m\times m}$. Then if $m \geq n$, and $V_f$ is full column rank, the matrices $M_q^{(p)}$ can be solved using the generalized inverse, denoted by $(\bullet)^+$, $$M_q^{(p)}=V_f^+ M_a^{(p)} V_f^{+T}. \tag{17}$$

Subsequently, the $p^{th}$ spectral auto-moment of stress at degree of freedom r can be estimated using the stress mode shapes, $\Phi^\sigma$, by, $$m_{\sigma rr}^{(p)}\phi_r^\sigma M_q^{(p)}\phi_r^{\sigma T}. \tag{18}$$

Here $\phi^\sigma_r$ is the $r^{th}$ row of $\Phi^\sigma$. Note that the stress spectral cross-moments can be solved for, but they are not needed for spectral fatigue damage estimation. The stress spectral auto-moments for $p \leq 4$ are then used for spectral fatigue damage using an appropriate spectral fatigue method. Acceptable spectral fatigue methods include the following, as well as others that will occur to those of skill in the art: narrow-band methods (e.g. Rayleigh damage), bi-modal methods (e.g. Jiao and Moan method), narrow-band with rainflow correction (e.g. Wirsching and Light method), broad-band methods (e.g. Dirlik's method) and nongaussian spectral methods. Details on the application of such methods can be found in numerous publications such as (see, e.g., Benasciutti, D., 2004, Fatigue Analysis of Random Loadings, Ph.D. Dissertation, Department of Civil and Industrial Engineering, University of Ferrara, Italy).

Response superposition is performed using straight-forward transformation and superposition methods, well-known to those skilled in the art of engineering mechanics.

Fatigue damage estimation, in at least one hybrid example, is computed in the time domain. The stress time series at desired locations on the structure are constructed by IFFT of the stress Fourier coefficients. Then, rainflow cycle counting is performed on each time series. A linear damage rule, such as the Palmgren-Miner rule (see, e.g., Benasciutti, D., 2004, Fatigue Analysis of Random Loadings, Ph.D. Dissertation, Department of Civil and Industrial Engineering, University of Ferrara, Italy) is applied, with the appropriate S-N curve to calculate the fatigue damage.

Traveling wave behavior results in complex modes. This can be seen by considering a transverse traveling wave on an infinitely long uniform marine riser, with wave number k, angular frequency ω), and amplitude α, $$x(z,t)=\alpha\exp{*}i(kz-\omega t)). \tag{19}$$

Here z is the discrete spatial coordinate along the riser, t is continuous time and i is the imaginary unit. Applying Euler's identity, this can be written as, $$x(z,t)=\alpha\psi\exp(-i\omega t), \text{ where}$$

$$\psi=\cos(ikz)+i\sin(ikz). \tag{20}$$

In the context of modal analysis, ψ can be considered a complex-valued modeshape with unity magnitude at every location. Plotting Re{ψ} vs. Im{ψ} results in a circle in the complex plane, whereas normal mode appears as a straight line. Notice that the real part is the same as the imaginary part shifted by 90 degrees. (Note that for a finite length uniform riser, boundary conditions force Re {ψ} to differ from a cosine function near the boundaries.)

Typically, riser transverse displacements are constrained to zero at the boundaries for modeling purposes. The normal modes of a uniform riser will then be sinusoids, making it easy to represent Im{ψ} with a single normal mode. However Re {ψ} requires several sine waves of differing frequency to approximate. These observations motivate the inclusion of Hilbert shapes derived from the normal modes.

Figure 10:
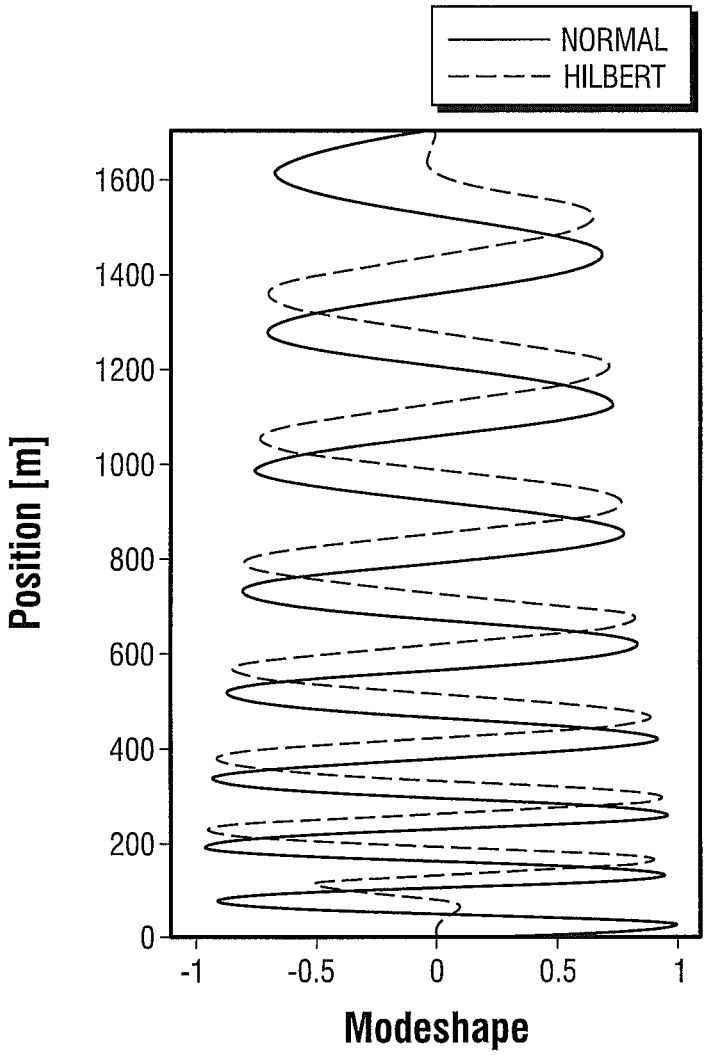
FIG. 10 depicts an example normal mode and corresponding Hilbert shape.

In one example, Hilbert shapes are computed in two steps. The first step is computing the Hilbert transform of the desired analytical modes according to the Matlab® m-files, ps90.m and ps90f.m, attached in Appendix B and Appendix C, respectively. Note that the resulting shape does not satisfy the zero-displacement boundary conditions. The second step is multiplying the Hilbert transform by a window function. The window function quickly decays to zero at the boundaries to rectify the boundary conditions. The window function is computed as in the Matlab® m-file, rect_tanh.m, attached in Appendix D. The resulting Hilbert shapes are additional smooth basis functions to include, to better resolve traveling wave behavior with a small number of basis vectors. An example Hilbert shape is shown in FIG. 10, along with the 16th mode of a uniform riser with linear tension, used to derive the Hilbert shape. In the illustrated example, the Hilbert shape is 90 degrees out of phase with respect to the normal mode and decays at the boundaries. This is significant because, in this example, a 90 degree phase difference is needed to construct a traveling wave when supplementing with the corresponding normal mode.

What is claimed is:

1. A method for accurate reconstruction of structural response due to external excitation, wherein the structure includes at least three sensors, the method comprising: identifying spectral peaks and spectral bands in the structure's vibration data, wherein, for each spectral band, the following steps are performed:

a. performing modal identification on measured vibration data, whereby a natural frequency and a modeshape of the empirical dominant mode is obtained, b. determining a corresponding natural frequency and modeshape of an analytical dominant mode having the best shape correlation to the empirical dominant mode, c. defining a set of candidate basis vectors from a plurality of modes with frequencies nearest a natural frequency of the analytical dominant mode, d. defining a set of participating basis vectors taken from the set of candidate basis vectors that results in the lowest error between reconstructed vibration data from a data set having data from some sensors and missing data from at least one omitted sensor and measured vibration at the at least one omitted sensor, and repeating the above steps for each independent direction of vibration.

2. The method as in claim 1, further comprising:

estimating generalized displacement data using the set of participating basis vectors, reconstructing stress data at a specific structural location from the estimated generalized displacement data, estimating acceleration data at sensor locations from the estimated generalized displacement data, computing fatigue damage from the determined stress data at the desired locations, and repeating the above steps for each independent direction of vibration.

3. The method as in claim 2, wherein said defining a set of participating basis vectors comprises performing multiple decompositions and reconstructions with subsets of candidate basis vectors while omitting the data from a single sensor, one omitted sensor at a time.

4. The method as in claim 3, wherein the performing of a decomposition and reconstruction comprises reconstructing vibration data at each omitted sensor location and comparing the reconstructed vibration data to measured vibration data from the same omitted sensor.

5. The method as in claim 3, wherein the performing of the decompositions and reconstructions comprises a spectral method.

6. The method as in claim 5, further comprising:

converting time series structural vibration data to vibration Fourier coefficients.

7. The method as in claim 6, further comprising converting structural vibration data to smooth Cross Spectral Density data and further comprising performing of modal identification on the smooth Cross Spectral Density data.

8. The method as in claim 7, further comprising:

forming a plurality of spectral cross-moment matrices, performing modal decomposition and reconstruction on the plurality of matrices to estimate several stress spectral auto-moments at desired locations in the structure, and estimating fatigue damage to the structure using spectral fatigue methods.

9. The method as in claim 6, further comprising: performing of modal identification on the Fourier coefficient data.

10. The method as in claim 3, wherein the performing of the decompositions and reconstructions comprises a hybrid time-domain/frequency-domain method.

11. The method as in claim 10, further comprising:

converting time series structural vibration data to vibration Fourier coefficients.

12. The method as in claim 11, further comprising converting structural vibration data to smooth Cross Spectral Density data and further comprising performing of modal identification on the smooth Cross Spectral Density data.

13. The method as in claim 12, further comprising:

performing modal decomposition and reconstruction on the vibration Fourier coefficients, determining stress Fourier coefficients at desired locations in the structure from the performing of modal decompositions and reconstructions.

14. The method as in claim 13, further comprising converting the stress Fourier coefficients to the time-domain.

15. The method as in claim 14, further comprising:

performing time-domain fatigue methods and estimating fatigue damage from said performing.

16. The method as in claim 11, further comprising: performing of modal identification on the Fourier coefficient data.

17. The method as in claim 1, further comprising:

acquiring measured vibration data samples from the sensors, and computing spectral moments from the measured vibration data.

18. The method as in claim 17, further comprising computing cross-spectral moments from the measured vibration data.

19. The method as in claim 1 wherein said sensor is taken from a group comprising: an accelerometer, an angular rate sensor, a linear variable differential transformer, laser vibrometer, photogrametry sensor, velocity probe, strain gauge, gyroscopes and an inclinometer.

20. The method as in claim 1 wherein said best shape correlation is determined using the modal assurance criterion (MAC).

21. The method as in claim 1 wherein said defining a set of candidate basis vectors comprises defining from a plurality of modes with frequencies nearest a natural frequency of the analytical dominant mode and Hilbert shapes derived from the modes.

22. The method as in claim 1, wherein said performing comprises time domain modal identification.

23. The method as in claim 22 wherein the time domain modal identification comprises:

converting Fourier coefficients to time series data and extracting modal parameters from the time-series data.

24. The method as in claim 22 wherein the time domain modal identification comprises:

converting Cross Spectral Density data to time series data and extracting modal parameters from the time-series data.

25. The method as in claim 1, wherein said performing comprises a spectral method.

26. The method as in claim 25, wherein said spectral method comprises performing modal identification on Fourier coefficients.

27. The method as in claim 25, wherein said spectral method comprises performing modal identification on smooth Cross Spectral Density data.

28. The method as in claim 27, wherein said spectral method comprises performing modal identification on Fourier coefficients.

29. The method as in claim 1, wherein said performing comprises a hybrid time-domain/frequency domain method.

30. The method as in claim 29, wherein said hybrid time-domain/frequency domain method comprises performing modal identification on Fourier coefficients.

31. The method as in claim 29, wherein said hybrid time-domain/frequency domain method comprises performing modal identification on smooth Cross Spectral Density data.

32. The method as in claim 31, wherein said hybrid time-domain/frequency domain method comprises performing modal identification on Fourier coefficients.

33. The method as in claim 1 wherein said vibration data comprises measured time-domain data.

34. The method as in claim 1 wherein said vibration data comprises Fourier coefficients calculated from measured time-domain data.

35. The method as in claim 1 wherein said vibration data comprises Cross Spectral Density data calculated from measured time-domain data.

* * * * *